US005885165A

United States Patent [19]

Krause

[11] Patent Number: 5,885,165

[45] Date of Patent: Mar. 23, 1999

[54] PUTTING TRAINING APPARATUS

[76] Inventor: James Alan Krause, 46286 Duke Ct., Shelby Township, Mich. 48315

[21] Appl. No.: 8,446

[22] Filed: Jan. 16, 1998

[51] Int. Cl.[6] ..... A63B 69/36

[52] U.S. Cl. ..... 473/200; 473/280

[58] Field of Search ..... 473/200, 280, 473/281

[56] References Cited

U.S. PATENT DOCUMENTS

| | | | |
|---|---|---|---|
| 3,184,234 | 5/1965 | Struble | 473/280 X |
| 3,918,720 | 11/1975 | Gordos . | |
| 4,278,254 | 7/1981 | Simjian | 473/200 |
| 5,595,546 | 1/1997 | Masters | 473/280 |

*Primary Examiner*—George J. Marlo

[57] ABSTRACT

The present invention provides a putting training apparatus (10) which, when used repeatedly by a golfer, permits him to develop a consistent stroke and accurate putting shot. The putting training apparatus (10) includes a pair of balls (12), preferably regulation golf balls, with a pivotal assembly (16) disposed between the balls (12) which permits relative rotation between the balls (12). The pivotal assembly (16) is positioned along a common axis (24) which passes through the center of the balls (12). The pivotal assembly (16) includes a shaft (30) having opposing ends (43) and at least one bearing (32) proximate to each of the opposing ends (43). A retainer (43') is utilized on each of the ends of the shaft to retain the bearings thereupon.

11 Claims, 2 Drawing Sheets

PUTTING TRAINING APPARATUS

TECHNICAL FIELD

This invention relates to a golf putting apparatus, more specifically, a golf putting apparatus which provides immediate, clearly discernible visual feedback to the golfer to inform him of improper contact with the golf ball during his putting swing.

BACKGROUND OF THE INVENTION

It is well known, that in golf like almost any sport, much practice and repetition of the fundamental components of the game is necessary to become proficient. In the sport of golf, this is particularly true of putting where the game is most often won or lost. The key to better putting is to be able to strike the ball with a straight stroke while maintaining the putter head square to the target line. Putting practice is undertaken by repetitively striking a golf ball on an even surface towards a cup. Through this repetitive motion, the player develops a consistent stroke by which he can place the ball in the cup. However, this method does not give the golfer visual feedback which quickly and clearly informs him of the problem with his putting stroke. What is desired is a putting training apparatus which will give the golfer reliable, easily discernible visual feedback on mishit golf balls during putting.

U.S. Pat. No. 3,918,720 issued Nov. 11, 1975 to Gordos discloses a pair of simulated golf balls spaced substantially apart. Although the limited disclosure of the patent is silent as to why the balls are substantially spaced apart, it is understood that a premature contact with one surface of a ball will be produce an arc with a rather large radius making it easy for the golfer to identify an incorrect swing. The device comprises balls which are made of solid rubber and not of regulation golf balls. Each of the balls is fixed to a rigid shaft and is not rotatable relative to the shaft.

U.S. Pat. No. 4,278,254 issued Jul. 14, 1981 to Simjian discloses several embodiments of an apparatus similar to the '720 patent. The patent teaches of two or three spaced apart golf balls with a shaft projecting through the center and the opposing surfaces of each of the balls. Alternatively, the patent teaches of one golf ball with a pair of wheels having a diameter larger than that of the golf ball. In each embodiment, the balls, or balls and wheels are fixed on an axis and roll as a unit.

SUMMARY OF THE PRESENT INVENTION

The present invention provides a putting training apparatus which, when used repeatedly by a golfer, permits him to develop a consistent stroke and accurate putting shot. The putting training apparatus includes a pair of balls, preferably regulation golf balls, with a pivotal assembly disposed between the balls which permits relative rotation between the balls. The pivotal assembly is positioned along a common axis which passes through the center of the balls. The pivotal assembly includes a shaft having opposing ends and at least one bearing proximate to each of the opposing ends. A retainer is utilized on each of the ends of the shaft to retain the bearings thereupon.

Accordingly, it is an object of the present invention to provide an improved putting training apparatus which when struck provides clear visual feedback on whether the apparatus was contacted squarely and thus allow the golfer to develop a consistent swing.

Another object of the invention is to provide a putting apparatus utilizing a pair of regulation golf balls in close proximity with each other to more closely simulate the contact felt in an actual putting situation and which when hit properly at the target is sized to drop into the cup.

Yet another object of the invention is to provide a device that allows rotation of the balls relative to one another to allow the arc of travel of the apparatus to be increased when the balls are mishit to increase the visual feedback.

Yet another object of the invention is to provide a putting apparatus which is durable, balanced, and free from bending when the apparatus is struck by the putter.

A further object of the invention is to provide a putting apparatus that is portable and compact and can easily be carried to and from a practice green and fit in the user's pocket or golf bag.

The foregoing and other objects, features and advantages of the present invention will become apparent in the light of the following detailed description of a preferred embodiment thereof as illustrated in the accompanying drawing.

DESCRIPTION OF THE INVENTION

Figure 1:
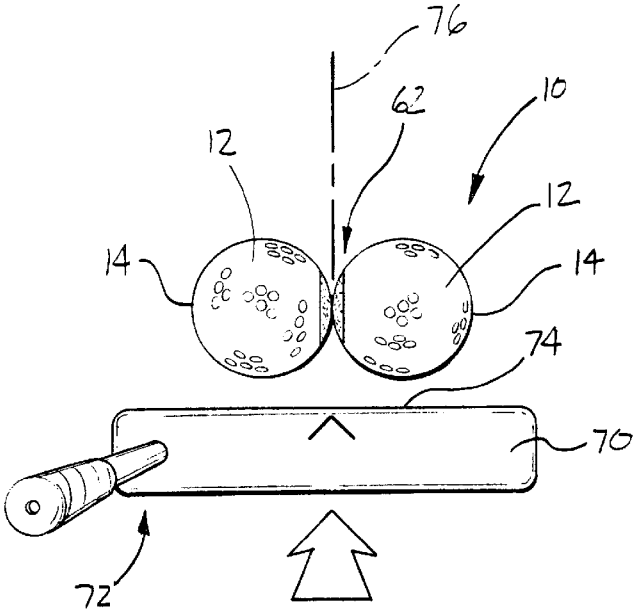
FIG. 1 is a top plan view of a putter prior to engagement with the putting training apparatus.

A putting training apparatus is generally shown in FIG. 3–6. The apparatus 10 comprises a pair of U.S.G.A regulation golf balls 12 having outer surfaces 14. It is to be understood that a prime on like reference numerals denotes like features. The golf balls 12 are joined by pivotal assembly 16 which allows the golf balls 12 to rotate relative to one another. That is, the pivotal assembly 16 is secured to each of the balls 12 in such a manner as to allow relative rotation between the balls 12 about a common orbit.

In the preferred embodiment, each of the golf balls 12 has a bore 18. The bore 18 is perpendicular to a plane 20 that is tangential to the outer surface 14 of the golf ball 12 and extends along the centerline of the ball. Additionally, each bore 18 of the golf balls 12 share an axis 24. Also, each bore 18 must be of the same depth to ensure that when the golf balls 12 are joined by the pivotal assembly 16 the putting training apparatus will be balanced about centerline 24, which serves as the axis of rotation.

The pivotal assembly 16 includes a cylindrical shaft 30 having opposing ends 43. A bearing 32 is positioned proximate to each of the opposing ends 43 of the shaft 30. A bronze oil-impregnated bearing is preferred, but it is to be understood that any suitable bearing material may be used. An example of such a bearing material is manufactured by Welker Bearing Co. manufactured from SAE 863 bronze.

The bearings comprise a hollow, cylindrical tube having an inner diameter 34 and an outer diameter 36. The shaft 30 has a diameter 40 slightly smaller than the inner diameter 34 of the bearing 32 to permit the shaft 30 to freely rotate within the bearings 32. The shaft 30 has chamfers 42 on either end 43 of the shaft 30 to facilitate assembly of the components onto the shaft 30, discussed in this and subsequent paragraphs.

The outer diameter 36 of the bearings 32 is slightly greater than the diameter of the bore 18 such that an interference fit is obtained when the bearings 32 is inserted in the bore 18 to thereby secure the ball 12 with the pivotal assembly 16. Also, the outer surface of the bearings 32 may be ribbed or have some other textured surface to create a more secure interference fit with the bore 18.

Optionally, the pivotal assembly 16 further includes a thin, annular sighting disc 46 disposed between the bearings 32 and between the balls 12 when the pivotal assembly is installed in the bores 18. (FIG. 3) The sighting disc 46 has a hole 48 through its center slightly larger than the diameter 40 of the shaft so that the disc 46 can be slid over the shaft 30 and is permitted to freely rotate about the shaft 30. The sighting disc 46 is substantially perpendicular to the shaft 30.

Figure 3:
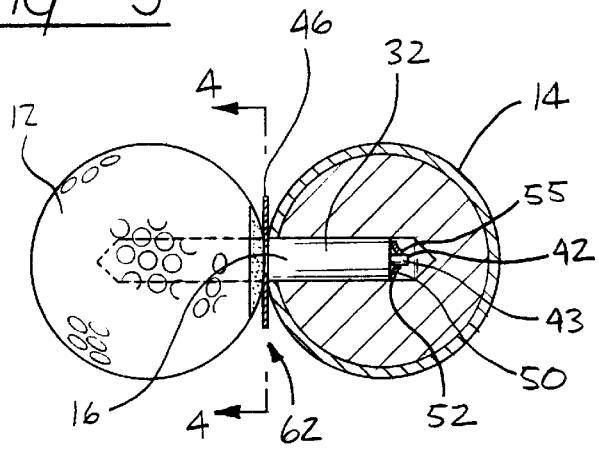
FIG. 3 is an elevational view, partially in cross-sectional of one embodiment of the putting training apparatus which utilizes spring clips as retainers on the pivotal assembly.
Figure 4:
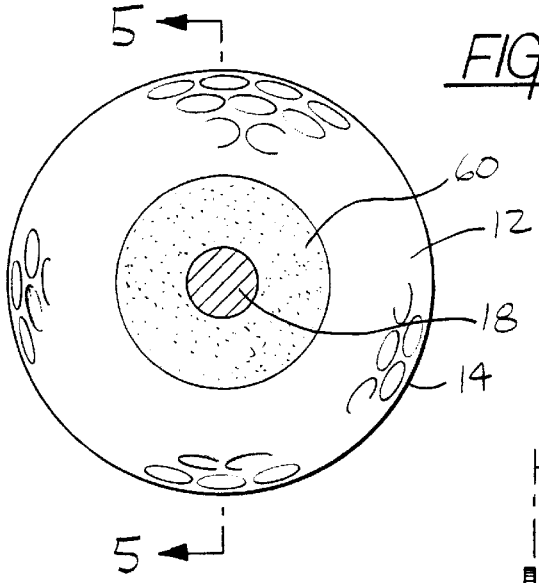
FIG. 4 is a side view of one embodiment partially in cross-section of the putting training apparatus taken along line 4—4 in FIG. 3.

In one embodiment shown in FIG. 3, spring clips 50 are used on each opposing end 43 of the shaft 30 to retain the disc 46 and bearings 32 on the shaft 30. The annular spring clips 50 have an outer diameter 52 and inner diameter 54. The spring clips 50 have a raised flange 55 about the inner diameter 54 which facilitates insertion of the shaft 30 into the spring clip 50 while preventing withdrawal of the shaft 30 from the inner diameter 54. Inner diameter 54 is less that diameter 40 of shaft 30 such that an interference fit is provided between the shaft 30 and spring clips 50. It is important that the outer diameter 52 of the spring clips 50 is less than that of the bores 18 in the golf balls 12 so that the shaft 30 does not become fixed in the bores 18 thus preventing relative rotation of the golf balls 12.

Figure 5:
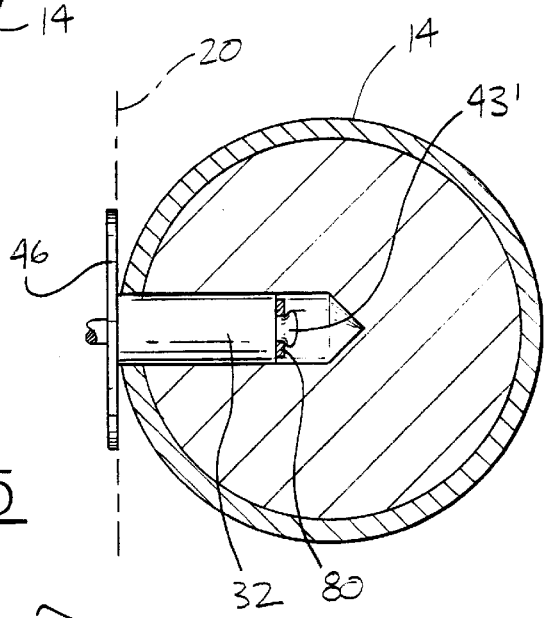
FIG. 5 is a cross-sectional view of a golf ball of the putting training apparatus taken along line 5—5 in FIG. 4, depicting the preferred embodiment of the present invention.
Figure 6:
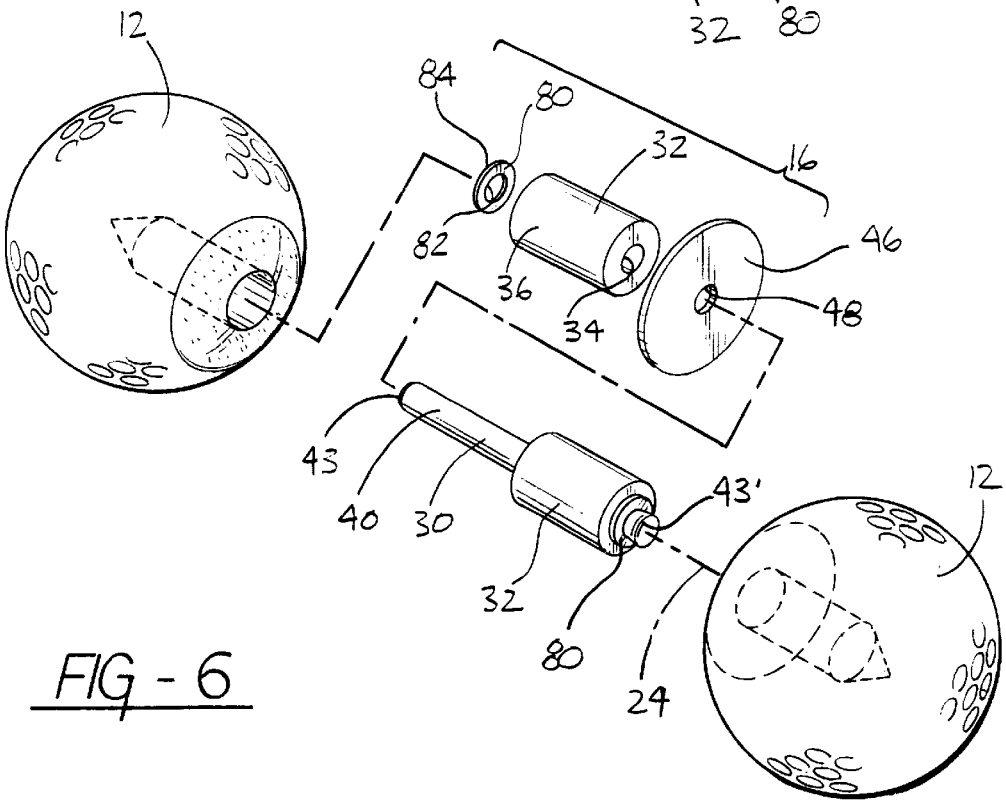
FIG. 6 is an exploded view of the preferred embodiment of the putting training apparatus.

In the preferred embodiment, as shown in FIGS. 5 and 6, the spring clips 50 are not utilized, but rather an alternative retaining configuration is incorporated for retaining the bearings 32 on the shaft 30. A pair of washers 80 are positioned at each end 43 of the shaft 30 and adjacent to the bearings 32. The washers have an inner diameter 82 and an outer diameter 84. The inner diameter 82 of each washer 80 is slightly larger than the outer diameter 40 of the shaft 30 so that the washer 80 may rotate freely on the shaft 30. The outer diameter 84 of the washer 80 is smaller than the bore 18 so that the washer 80 will not bind up in the bore 18.

During assembly, after the sighting disc 46 has been disposed on the shaft 30 between the bearings 32, the opposing ends 43 of the shaft 30 are plastically deformed, best shown at 43 in FIGS. 5 and 6. The deformation is such that the ends 43' of the shaft 30 become larger than the inner diameter 82 of the washers 80 thereby retaining the washers 80, bearings 32, and sighting disc 46 as a self-contained assembly 16. It is contemplated that the deformation is accomplished by opposing compression forces applied perpendicular to the axis of the shaft 30. However, it is to be understood that in the preferred embodiment any suitable manufacturing method that causes the ends of the shaft 30 to have a larger diameter than the inner diameter 82 of the washer 80 is acceptable.

The washers 80 are necessary so that when the bearings 32 rotate relative to the shaft 30 the shaft ends 43 will not bind in the inner diameter 34 of the bearings 32. Rather if the shaft ends 43 bind, they will bind in the inner diameter 82 of the washer 80. Thus, the shaft 30 is free to rotate relative to the bearings 32 which in turn coacts with the bore 18 of a each respective golf ball 12.

The disc 46 can be used in conjunction with a pair of shaded sighting areas 60 to create a target 62 at which the golfer can aim the center of the putter. The shaded sighting area 60 should be of a color that contrasts with the color of the golf balls being utilized and which can be easily seen when placed on the green. The shaded sighting area is depicted as a circular colored area surrounding the insertion point for the shaft but can be of any shape and size. Alternatively, the shaded sighting areas 60 can be used instead of the sighting disc 46, or visa versa.

When assembled, the balls 12 of the apparatus 10 are adjacent one another without significant spacing therebetween, as shown in FIGS. 1 and 3.

Figure 2:
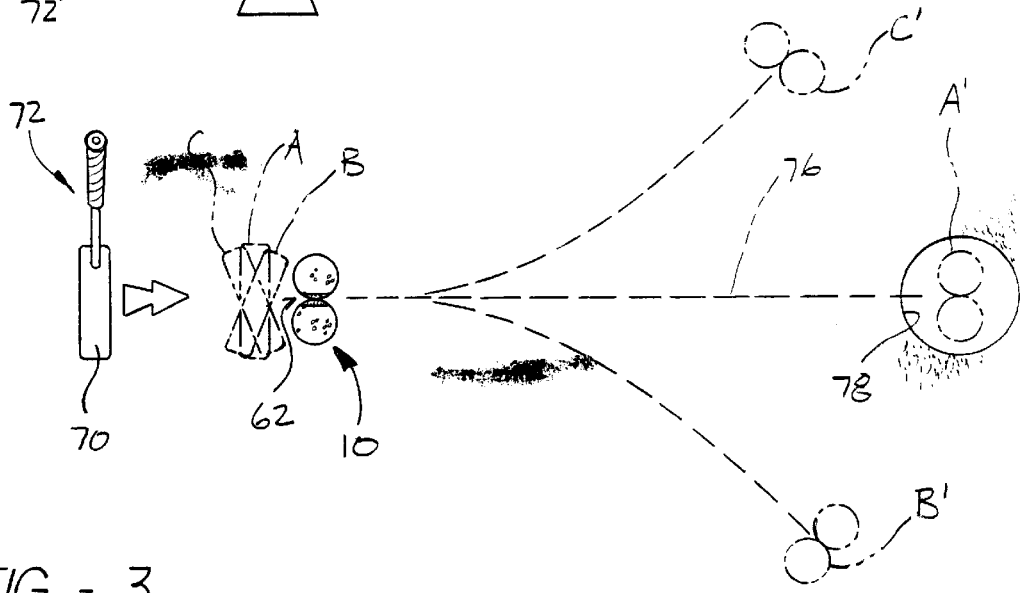
FIG. 2 is an top plan view of the putting training apparatus after contact with a putter head at various positions of contact.

The putting training apparatus positioned for use is generally shown at 10 in FIGS. 1 and 2. Visual feedback is provided by the putting training apparatus 10 when the apparatus 10 is utilized on a substantially even putting surface.

In operation, the golfer attempts to strike the target 62 area at the center of the apparatus 10 with the center of the head 70 of the putter 72. In addition to hitting the apparatus 10 on center, the golfer must also strike both surfaces 14 of the golf balls 12 simultaneously with the club face 74 in order to impart linear motion 76 to the apparatus 10. If the surface 14 of one ball 12 is contacted before the other then the apparatus 10 will roll in an arc away from the intended target which is typically a cup 78 on a golf green.

When the golf training apparatus 10 is hit with the putter 72 correctly (shown by putter position A in FIG. 2) the apparatus 10 will roll in a straight line to the cup 78 (apparatus position A'). If the top golf ball (as depicted in FIG. 2) of the apparatus 10 is contacted by the club face 74 prior to contact with the bottom golf ball (putter position B), the apparatus will roll to the right of the cup 78 (apparatus position B'). If the lower golf ball (as depicted in FIG. 2) of the apparatus 10 is contacted by the club face 74 (putter position C) prior to contact with the top golf ball, the apparatus will roll to the left of the cup 78 (apparatus position C').

Allowing relative rotation between the balls, as compared to a fixed relationship, increases the radius of the arc when the apparatus is mishit, thereby increasing the visual feedback. Thus, more precise contact between the putter and apparatus is required to have the apparatus reach the intended target. Hence, practice will yield a more accurate putting swing.

The compact arrangement of the present invention allows the training apparatus 10 to fit in the cup 78 giving satisfaction to the golfer when the apparatus is hit correctly and drops into the cup 78 as desired. Additionally, the apparatus is conveniently portable and can be used with putting targets typical used indoors such as in homes or offices.

Several embodiments have been described in detail but the invention is not restricted thereto. It should be understood that the putting training apparatus may be assembled in any order and that modifications to the components of the assembly may be made to achieve the same result.

What is claimed is:

1. A putting training apparatus comprising:

a pair of balls, each being of approximately the size of a golf ball;

a common axis passing through the center of each of said balls; and a pivotal assembly securing said balls to each other at a distance for being addressed by a putter, for allowing relative rotation between said balls about said common axis during use of the apparatus.

2. The putting training apparatus as set forth in claim 1 wherein said pivotal assembly is rotatably secured to each of said balls.

3. The putting training apparatus as set forth in claim 2 wherein said pivotal assembly comprises:

a shaft having opposing ends;

at least one bearing proximate to each of said opposing ends; and a retainer on each of said opposing ends adapted to retain said bearings on said shaft.

4. The putting training apparatus as set forth in claim 3 wherein said apparatus includes a sighting area centrally located on said apparatus.

5. The putting training apparatus of claim 4 wherein said sighting area comprises a colored region on said pair of balls in the area adjacent said pivotal assembly.

6. The putting training apparatus of claim 4 wherein said said sighting area comprises a sighting disc located on said pivotal assembly in the area between said balls.

7. The putting training apparatus of claim 3 wherein each of said balls includes a bore along said common axis, said opposing ends of said pivotal assembly being disposed in said bores.

8. The putting training apparatus of claim 7 wherein said balls are golf balls.

9. The pivotal assembly of claim 3 wherein said retainer is a spring clip.

10. The pivotal assembly of claim 3 wherein the retainer is a plastically deformed region of said opposing ends.

11. The pivotal assembly of claim 10 further comprising a washer disposed between said plastically deformed region and said at least one bearing.

* * * * *